US005305659A

United States Patent [19]

Dieperink et al.

[11] Patent Number: 5,305,659

[45] Date of Patent: Apr. 26, 1994

[54] TOOLING FOR FOLDING PRESS FOR AIR FOLDING

[75] Inventors: Willem Dieperink, Buchillon; Claude Croisier, Bière, both of Switzerland

[73] Assignee: Beyeler Raskin S.A., Bussigny, Switzerland

[21] Appl. No.: 48,208

[22] PCT Filed: Sep. 11, 1990

[86] PCT No.: PCT/CH90/00216

§ 371 Date: May 10, 1991

§ 102(e) Date: May 10, 1991

[87] PCT Pub. No.: WO91/03332

PCT Pub. Date: Mar. 21, 1991

Related U.S. Application Data

[63] Continuation of Ser. No. 675,899, May 10, 1991, abandoned.

[30] Foreign Application Priority Data

Sep. 11, 1989 [CH] Switzerland ..... 3297/89

[51] Int. Cl.[5] ..... B21D 37/02

[52] U.S. Cl. ..... 72/389; 72/413; 72/446; 72/481

[58] Field of Search ..... 72/389, 446, 448, 413, 72/481

[56] References Cited

U.S. PATENT DOCUMENTS

| | | | |
|---|---|---|---|
| 784,725 | 3/1905 | Yates | 72/389 |
| 4,106,323 | 8/1978 | Haenni et al. | 72/389 |
| 4,367,644 | 1/1983 | Kramer et al. | 72/389 |
| 4,653,307 | 3/1987 | Zbornik | 72/389 |
| 4,926,676 | 5/1990 | Bailey et al. | 72/389 |

FOREIGN PATENT DOCUMENTS

| | | | |
|---|---|---|---|
| 0096211 | 12/1983 | European Pat. Off. . | |
| 330258 | 8/1989 | European Pat. Off. | 72/389 |
| 3235775 | 3/1984 | Fed. Rep. of Germany | 72/389 |
| 3245755 | 6/1984 | Fed. Rep. of Germany | 72/389 |
| 2315334 | 6/1976 | France . | |
| 2411043 | 7/1979 | France | 72/389 |
| 0029830 | 9/1975 | Japan | 72/389 |
| 0496072 | 12/1975 | U.S.S.R. | 72/389 |

*Primary Examiner*—David Jones

*Attorney, Agent, or Firm*—Jacobson, Price, Holman & Stern

[57] ABSTRACT

A pair of female die parts are mounted on a table of a lower frame of a folding press for forming a folding groove. One of the female die parts is slidably adjustable on the table with respect to the other female die part by an adjusting device including pairs of first and second tapered shims. The first and second shims of each pair are slidably arranged with respect to each other. The first shims are coupled with the adjustable female die part and the second shims of each pair are coupled with an actuating member connected to a driving device for adjusting the position of the second shims with respect to the first shims.

13 Claims, 2 Drawing Sheets

TOOLING FOR FOLDING PRESS FOR AIR FOLDING

This application is a continuation of application Ser. No. 07/675,899, filed May 10, 1991, now abandoned.

The present invention relates to a tooling for a folding press for air folding.

When it is desired to fold sheets of different thicknesses by means of a folding press comprising a known tooling, it is necessary to proceed to a change of die which requires important means regarding equipment and manpower for handling with a view to the size and the weight of the dies which are generally used. Since any change of die requires a new adjustment of the press, the time for adjustment adds to the time of changing and implies important time losses. The same problem arises when it is desired to change the radius of the folding to be obtained.

The object of the present invention is to remedy the above inconvenience by proposing a tooling for a folding press allowing to fold sheets of different thicknesses with the same die.

To this effect, the invention relates to a tooling for a folding press for air folding.

Figure 2:
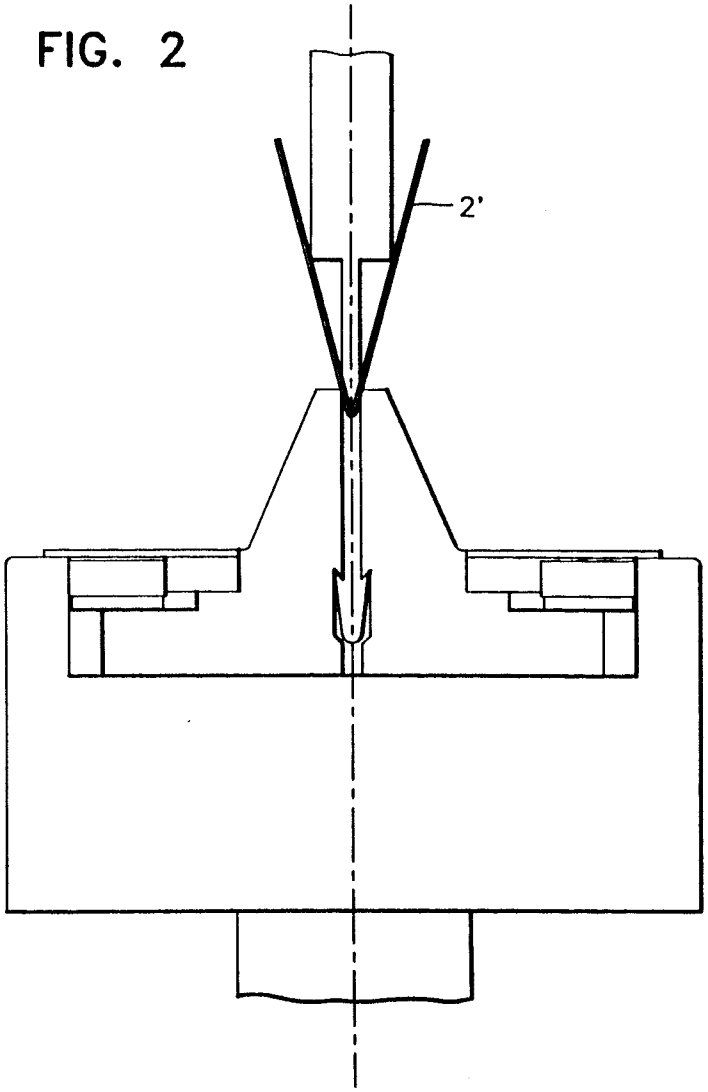
Figure 1:
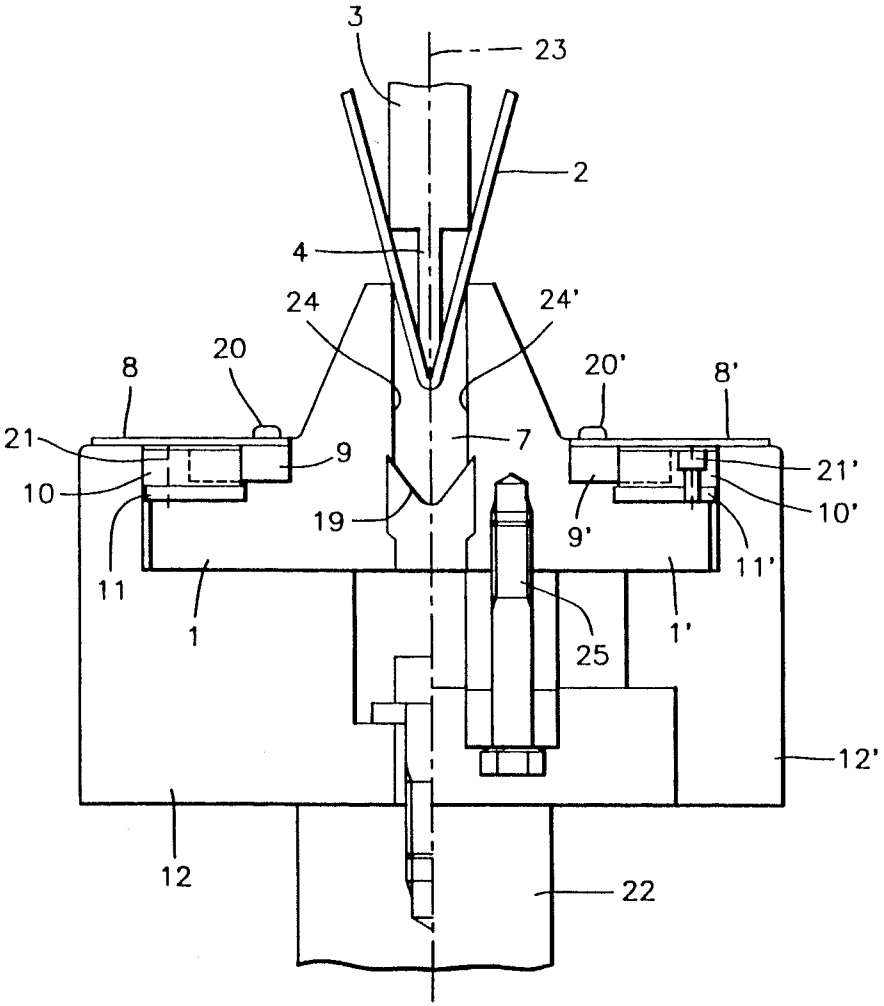
Figure 3:
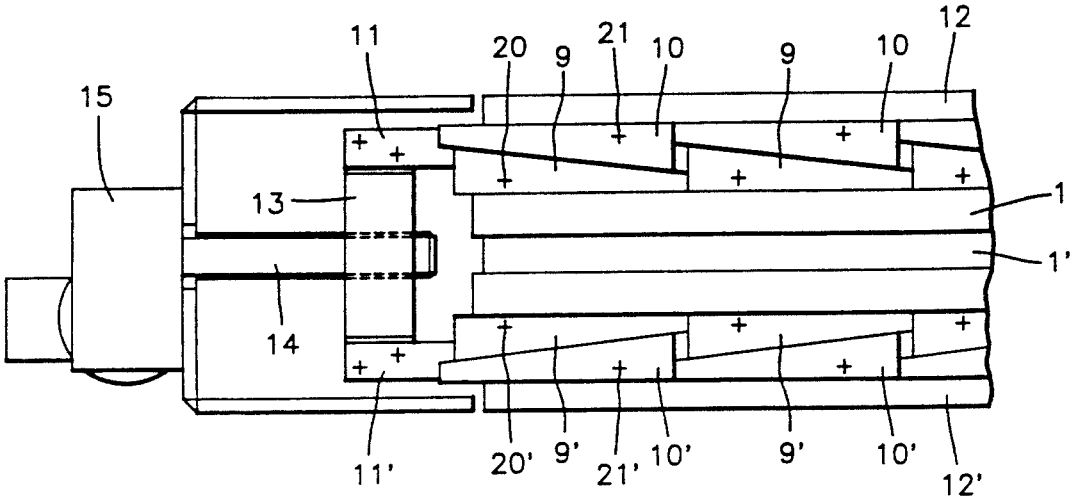
Figure 4:
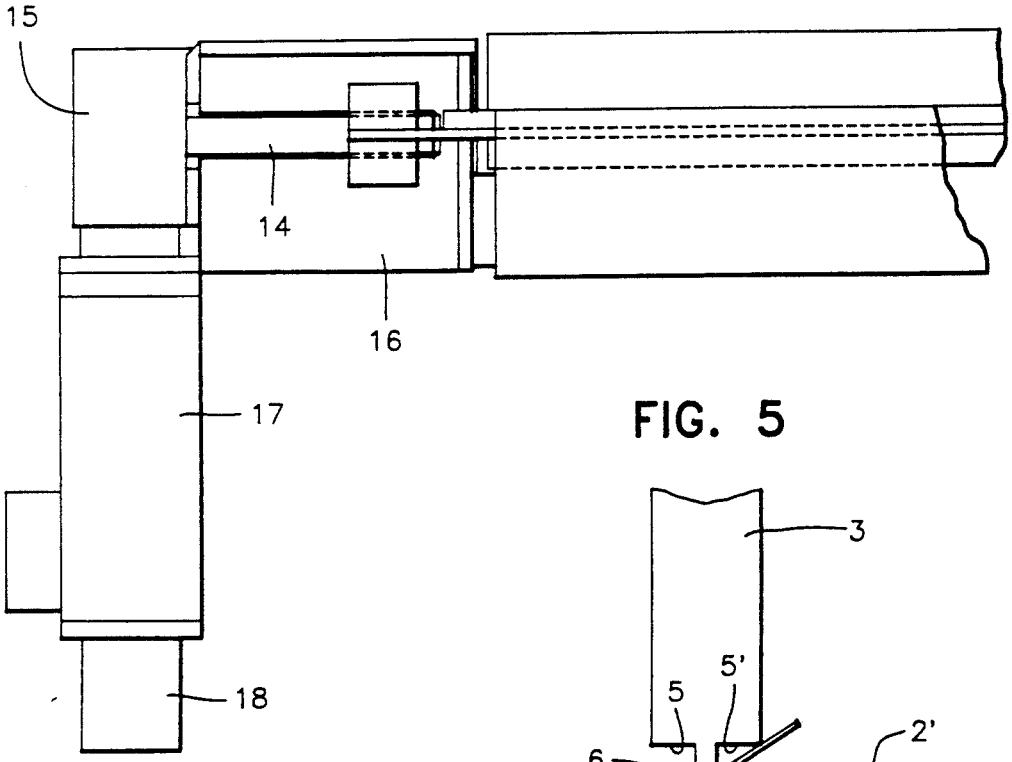
Figure 5:
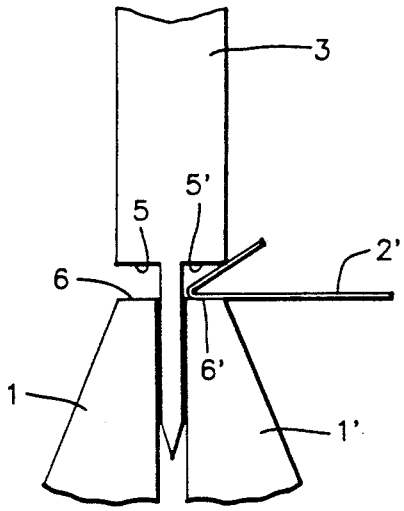

The invention will be well understood with the help of the following description of a tooling for a folding press according to the invention, given by way of example and with reference to the drawing in which FIG. 1 is a vertical section of the tooling, FIG. 2 is a vertical section of the tooling of FIG. 1 programmed for other conditions of folding than those of FIG. 1, FIG. 3 is a view from above of the actuating device for the movement of the two half-dies, FIG. 4 is a lateral view of the device of FIG. 3, and FIG. 5 is a partial vertical section of the tooling of FIG. 1 programmed for making crushed foldings.

The tooling shown in FIGS. 1 to 5 is mounted on a table of the lower frame 22, the table comprising two parts 12,12' arranged on either side of the folding plane 23 defined by the movement of the edge of the end of the male die 3,4. Two half-dies 1,1' are arranged on the respective parts 12,12' of the table on either side of the folding plane 23, symetrically with respect to that plane. Each of the half-dies comprises a vertical longitudinal face 24,24', said two vertical faces being spaced from each other so as to present a vertical space forming the folding V. Each of the half-dies 1,1' is arranged on one of the corresponding parts 12,12' of the table, so as to be capable of laterally sliding with respect to these parts.

The tooling includes a symetrical actuating device for the movement of each of the two half-dies. This device comprises for each of the half-dies a plurality of pairs of inclined shims 9,10, respectively 9',10', arranged horizontally at the upper outer part of half-die 1, respectively 1', covered by covering plates 8, respectively 8'. The shims 9, respectively 9', which can be considered as fixed shims, are secured to the half-die 1, respectively 1', by means of fixing devices 20, respectively 20', for example by screws. The shims 10, respectively 10', which can be considered as the movable shims, are fixed on a traction bar 11, respectively 11', by means of fixing devices 21, respectively 21', for example by screws. As shown in FIGS. 3 and 4, the respective ends of the traction bars 11 and 11' are fixed on either side of a screw-nut 13, cooperating with a ball screw 14, itself coupled with a worm reduction gearing 15 coupled with a d.c. motor 17, the whole being mounted on a support 16. The motor is connected to an incremental sensor 18 and is controlled by a programmable electronic device, such as for example a numerical control device or a computer.

When the above described driving device acts to pull the bars 11,11', so as to move the same towards the left on FIG. 3, the inclined shims 10,10' also move towards the left and subject the shims 9,9' to a lateral movement in the direction of the folding plane 23, bringing the two half-dies closer to each other and, consequently, lead to a reduction of the width 7 of the folding V. When the driving system acts in the other direction, the inclined shims 10,10' move in the opposite direction and allow the two half-dies to move apart under the action of a separation means, such as for example a bent spring steel blade 19, as shown in FIG. 1, the longitudinal ends of said blade being fixed to each of the two half-dies towards the bottom of the folding V. By its spring action, said blade exerts a continuous pressure on the respective walls 24,24' of the half-dies 1,1' tending to open the folding V. The blade 19 has also a sealing function for closing the bottom of the folding V.

According to a variant of embodiment, the spring steel blade 19 can be replaced by a device for driving the fixed shims 9 by the movable shims 10 (respectively the fixed shims 9' by the movable shims 10'), as for example an arrangement of the shims with grooves for the longitudinal sliding of a shim with respect to the other, or by any other driving device.

The sliding of the half-dies 1,1' on the parts 12,12' of the table can be obtained, for example, by mere placing a lubricant between the lower plane surfaces of the half-dies and the upper plane surfaces of parts 12,12' of the table. In order to avoid rocking of the half-dies in the course of the folding at small openings of the folding V, each of the half-dies can be made integral with the table by means of a screw 25.

FIG. 2 shows the tooling of FIG. 1 programmed for the folding of a sheet 2' of smaller thickness than that of sheet 2 shown in FIG. 1.

According to a preferred embodiment of the male die, such as shown in the Figures, the male die 3,4 comprises edges 5,5' for cooperating with the upper surfaces 6,6' of the two half-dies in order to allow the producing of crushed foldings (FIG. 5).

The tooling shown in FIGS. 1 to 5 comprises symetrical half-dies, the movement of the same being effected by an equally symetrical device driven by a single motor. It can, of course, also be provided with two motors acting respectively to move each of the two half-dies, or with a single motor acting to move a single one of the half-dies, the other one being stationary.

The actuating device of the movement of the half-dies, as described above, could also be replaced by a screw device or by an outer hydraulic device.

According to a variant of an embodiment, the tooling can be actuated by a device comprising a plurality of pairs of inclined shims arranged in the center of the die between the two half-dies, aiming at actuating the opening of the die, the closing of the die being actuated by a lateral compression device of the two half-dies operating hydraulically or mechanically.

We claim:

1. A tooling for a folding press for air folding comprising a male die and a female die, the female die including two parts mounted on a table of a lower frame of said press for forming a folding V and arranged to allow modification of a width of the folding V by moving of at least one of said two parts, and separating means including a spring steel blade including two longitudinal sides and arranged inside said folding V between said parts for separating said two parts, said longitudinal sides of the blade being secured to each of the two parts, respectively.

2. A tooling according to claim 1, wherein said female die comprises two half-dies, at least one of the two half-dies being mounted on said table so as to be capable of sliding laterally with respect to said table.

3. A tooling according to claim 1, the male die comprising an edge defining a folding plane when said male die moves down, wherein said female die comprises two half-dies arranged on either side of said folding plane, each of the half-dies being mounted on said table so as to be capable of sliding laterally with respect to said table.

4. A tooling according to claim 1, wherein each of the two parts is integral with a device comprising a plurality of pairs of first and second inclined shims provided to move said two parts, said first and second shims of each part being slidably arranged with respect to each other, said first shims of a pair being fixed on one of the parts and said second shims being fixed on a pulling member connected to an automatic driving device controlled by a programmable electronic device.

5. A tooling according to claim 4, wherein said separating means is adapted to produce an opening of the folding V by a moving apart of the two parts, and a closing of the folding V being produced by a moving of said pulling member.

6. A tooling according to claim 4, wherein said pulling member includes a longitudinal bar, fixed at one end on a driving device.

7. A tooling according to claim 6, wherein the driving device includes a screw-nut, on either side of which are fixed ends of the longitudinal bar, said screw-nut being mounted on a screw coupled with a reduction device coupled to a motor.

8. A tooling according to claim 3, wherein the male die includes lateral shoulders adapted to cooperate, respectively, with upper edges of each of the two parts, so as to allow crushed folding of a sheet between said shoulders and edges.

9. A tooling for a folding press comprising:

a male die and a pair of female die parts mounted on a table of a lower frame of said press for forming a folding groove, at least one of the female die parts of said pair being slidably adjustable on said table with respect to the other female die part by an adjusting device allowing adjustment of a width of said folding groove, said adjusting device comprising a plurality of pairs of first and second tapered shims, said first and said second shims of each pair being slidably arranged with respect to each other, said first shims of each pair being coupled with said adjustable female die part and at least said second shims of each pair being coupled with an actuating member connected to a driving device for adjusting the position of said second shims with respect to said first shims, elastic means for acting on said adjustable female die parts for urging the same against the action of said tapered shims.

10. A tooling according to claim 9, wherein both female die parts of said pair are slidably adjustable on said table with respect to each other by said adjusting device allowing adjustment of a width of said folding groove, said adjusting device comprising two such said plurality of paris of first and second shims, each of said plurality of shims being associated respectively with one of the female die parts.

11. A tooling according to claim 10, wherein said elastic means comprise a spring steel blade arranged inside said folding groove between said adjustable female die parts.

12. A tooling according to claim 9, wherein said second shims of each pair are connected to a longitudinal bar having one of its ends connected to said driving device.

13. A tooling according to claim 9, wherein said female die parts comprise upper edges and said male die comprises lateral shoulders adapted to cooperate with said upper edges of said female die members for folding a sheet between said edges and said shoulders.

* * * * *

UNITED STATES PATENT AND TRADEMARK OFFICE

CERTIFICATE OF CORRECTION

PATENT NO. : 5,305,659

DATED : April 26, 1994

INVENTOR(S) : DIEPERINK et al.

It is certified that error appears in the above-identified patent and that said Letters Patent is hereby corrected as shown below:

At column 4, claim 10, line 29, "paris" should read --pairs--.

Signed and Sealed this

Twenty-first Day of February, 1995

*Attest:*

Bruce Lehman

BRUCE LEHMAN

*Attesting Officer*

*Commissioner of Patents and Trademarks*